United States Patent [19]

Kneubühl

[11] Patent Number: 4,517,897

[45] Date of Patent: May 21, 1985

[54] SMALL ARMS PROJECTILE

[75] Inventor: Beat Kneubühl, Oberdiessbach, Switzerland

[73] Assignee: Schweizerische Eidgenossenschaft, Vertreten Durch Die Eidg. Munitionsfabrik Thun Der Gruppe Für Rüstungsdienste, Thun, Switzerland

[21] Appl. No.: 434,911

[22] Filed: Oct. 18, 1982

[51] Int. Cl.[3] ..... F42B 11/08

[52] U.S. Cl. ..... 102/439; 102/501; 102/514

[58] Field of Search ..... 102/430–440, 102/501, 514–519

[56] References Cited

U.S. PATENT DOCUMENTS

| | | | |
|---|---|---|---|
| 2,465,962 | 3/1949 | Allen et al. | 102/430 X |
| 3,442,216 | 5/1969 | Six et al. | 102/514 |
| 3,988,990 | 11/1976 | McDonald, Jr. et al. | 102/516 X |
| 4,063,511 | 12/1977 | Bullard | 102/436 |

*Primary Examiner*—Harold J. Tudor
*Attorney, Agent, or Firm*—Werner W. Kleeman

[57] ABSTRACT

A piece of small arms ammunition includes a jacket bullet of an aerodynamically optimized configuration having a profile, with the exception of its ends and of an attachment section, which is drag optimized in accordance with a relation derived from the known Haack equation. The range probable error of the ammunition is further additionally and advantageously affected by the design of the head and tail end of the bullet.

14 Claims, 3 Drawing Figures

SMALL ARMS PROJECTILE

BACKGROUND OF THE INVENTION

The invention relates to small arms ammunition comprising a cartridge case adapted to contain a powder charge and having an open end, a closed end and a logitudinal axis, a percussion cap substantially centered at said closed end and a rotationally symmetric jacket bullet enclosing a metallic core located at said open end. The invention, also, relates to a jacket bullet of the kind just mentioned.

For clarification, the term "small arms" in this context relates to subcaliber arms having a caliber below 0.5 in (12.7 mm) and particularly to a caliber in the range of 0.17 to 0.25 in (4 to 6.35 mm).

A rotationally symmetric jacket bullet is known from a publication by the US Department of Commerce, National Technical Information Service, No. AD-A025 131 (Michael Pino, "The effect of varying certain parameters on the performance of the S.C.A.M.P. produced 5.56 mm projectile", DARCOM Intern Training Center, May 1976). The known bullet has an ogive-shaped profiled portion, a cylindrical central portion and a frustroconically-shaped rear portion. It is at first stated in the report (see page 3, para 2, lines 4 to 5) that "more specifically there is no published material on the effects of ogive, nose radius, or boattail, or spin rate". The profiled portion may be shaped parabolically, conically or spherically (1.c, page 24), however, said profiled portion is stated to require a change in rifle design if changed (see page 9, lines 2 to 4: "The ogive cannot be changed because of the effect of necessitating a complete redesign of the rifle.") Correspondingly the author of this report restricts himself to the effects produced by variations in the shape of the head and/or in the shape of the tail on the bullet performance.

In a paper presented at the International Symposium on Small Arms, Aberdeen, USA, in October 1979, by Beat Kneubühl of the Armament Technology and Procurement Group, Ministry of Defense, Switzerland, the optimation of shapes for small arms bullets, in particular of the profiled portion in jacket bullets for small arms ammunition with respect to drag is reported. Starting point in the optimation is a mathematical formula developed by Haack for a projectile shape of minimum drag applicable to large-caliber projectiles having muzzle velocities in the supersonic range (Oerlikon Taschenbuch, Werkzeugmaschinenfabrik Oerlikon-Bührle AG, Zürich, Schweiz, May 1981, Chapter 5.2.3., page 168 to 171). A parameter equation is derived therefrom for the calculation of an optimal shape with respect to drag for the profiled portion of the small arms bullet as mentioned.

SUMMAY OF THE INVENTION

It is one object to be achieved by the invention to provide for small arms ammunition or a jacket bullet therefor of the initially mentioned kind which has an improved hit probability.

It is an object to be achieved by the invention to provide for small arms ammunition or a jacket bullet therefor of the initially mentioned kind which also has improved flight properties.

It is a further object to be achieved by the invention to provide for a jacket bullet for small arms ammunition of the kind mentioned initially which has an increased ballistic final impact energy.

It is another object to be achieved by the invention to provide for a jacket bullet for small arms ammunition of the kind mentioned initially which has an increased velocity of flight.

It is also an object to be achieved by the invention to provide for a jacket bullet for small arms ammunition of the kind mentioned initially which shows lower cross-wind deflection.

Furthermore, it is an object to be achieved by the invention to provide for a jacket bullet for small arms ammunition of the kind mentioned initially the shape of which results in a minimized forebody drag without impairing the ballistic final impact energy.

Also, it is an object to be achieved by the invention to provide for a jacket bullet for small arms ammunition of the kind mentioned initially which has improved flight properties and which can be manufactured as simply as possible in large numbers.

It is a final object to be achieved by the invention to provide for small arms ammunition and a jacket bullet therefor of the initially mentioned kind which is readily exchanged for the presently available ammunition without requiring any rifle redesign, particularly in respect of spin rate.

The invention is based on the surprising recognition that, contrary to expectation, an aerodynamic design of small arms ammunition and of the small-caliber jacket bullets used therein affects the hit probability for such bullets to a very significant degree despite the small size, the relatively short range and the relatively short flight time typical therefor.

According to the invention said objects are achieved in small arms ammunition and in jacket bullets of the initially mentioned kind by the bullet being shaped so as to be aerodynamically optimized in respect of drag and being provided, with the exception of said opposed ends and said attachment section, with a profile which is determined solely by a continuous function r(x) having a finite value of the continuous differential quotient (dr/dx); said profile of the jacket bullet having an imaginary tip which is spaced by a distance —s from the origin of a rectangular coordinate system, the positive x-axis of which represents a jacket bullet axis of symmetry and the y-axis of which represents a direction of the bullet radius r, while a real tip of said bullet is located at the origin of said coordinate system. The profile of the bullet is determined, with the exception of said opposed ends and said attachment section for the cartridge case, by a sum function $$r(x)=r_1(x_1)+r_2(x_2)$$

in which the range of $x_1$ is defined by $$x_1=(h/2)(1-\cos a)-(s/2)(1+\cos a),$$

h representing an imaginary length of said bullet from $x_1$ as determined by $a=\pi$ to the imaginary tip of said bullet and arc cos $(h-s)/(h+s) \leqq a \leqq \pi$, while the associated values of $r_1$ are given by $$r_1 = r_o\sqrt{\frac{1}{\pi}\left(a - \frac{1}{2}\sin 2a\right)},$$

wherein arc cos $(h-s)/(h+s) \leqq a \leqq \pi$, and in which the range of $x_2$ is defined by $$x_2 > h,$$

with $r_2 = \text{constant} = r_0$ (maximum radius of the bullet)

Advantageously, the jacket bullet according to the invention is manufactured from plated alloyed steel by deep drawing.

The amount of the distance $-s$ in the jacket bullet according to the invention is in the range of 0.1 to 0.5 $r_0$; such design of the head of the jacket bullet is expedient since well-defined turbulences are generated thereby which preclude instabilities due to exlusive laminar flow. The location of the attachment region for the cartridge case is such that a small section of the cylindrical portion projects from the cartridge case when the same is attached to the bullet according to the invention which results in improved guidance. Conveniently, a two-part frustroconical portion forms the rear portion of the jacket bullet according to the invention whereby the stability and the flight properties of the bullet are favourably affected additionally.

BRIEF DESCRIPTION OF THE DRAWINGS

Further objects and advantages achieved by the invention will become apparent and the invention will become better understood by the subsequent description of specific embodiments of the invention with reference to the annexed drawings wherein.

DESCRIPTION OF THE PREFERRED EMBODIMENTS

Figure 1:
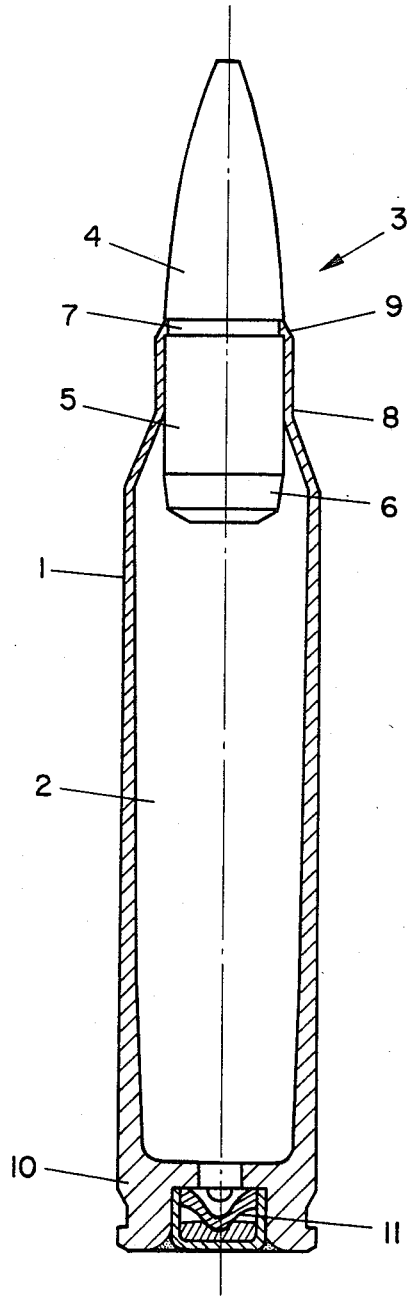
FIG. 1 represents a longitudinal section of a piece of small arms according to the invention.

Referring to FIG. 1, there is shown a longitudinal section of a piece of ammunition having a caliber of 0.223 Rem (5.56 mm) which is a conventional type of small arms ammunition. The piece comprises a conventional cartridge case 1 made of brass which contains a powder charge 2 of conventional composition like, for example, a small arms smokeless powder and further comprises a jacket bullet 3 attached thereto. The jacket thereof is made of a material conventionally used therefor like plated alloyed steel or nonferrous metal rich in copper and encloses a core 27 made of a material conventionally used therefor like lead or a lead alloy, but may also be made of steel or of sintered material. The jacket bullet 3 comprises a front portion 4 which is aerodynamically optimized in shape to minimize drag as described in detail hereinbelow, a substantially cylindrical central portion 5 and a generally frustroconically-shaped rear portion 6. The central portion 5 has a groove 7 instead of which the central portion 5 may also be knurled for attachment of a rim 9 of an open end 8 of cartridge case 1. The cylindrical portion 5 extends outwardly from the attachment section by 0.01 in (0.254 mm) which is the equivalent of about 0.1 $r_0$ with $r_0$ representing the radius of the cylindrical central portion 5 i.e., the maximum bullet radius. The extension may measure anywhere in the range of 0.1 to 0.5 $r_0$. The remaining portion thereof and the rear portion 6 are enclosed in cartridge case 1. A percussion cap 11 is placed into the closed end 10 of the cartridge case 1 and is centered with respect to the longitudinal axis of the same.

Figure 2:
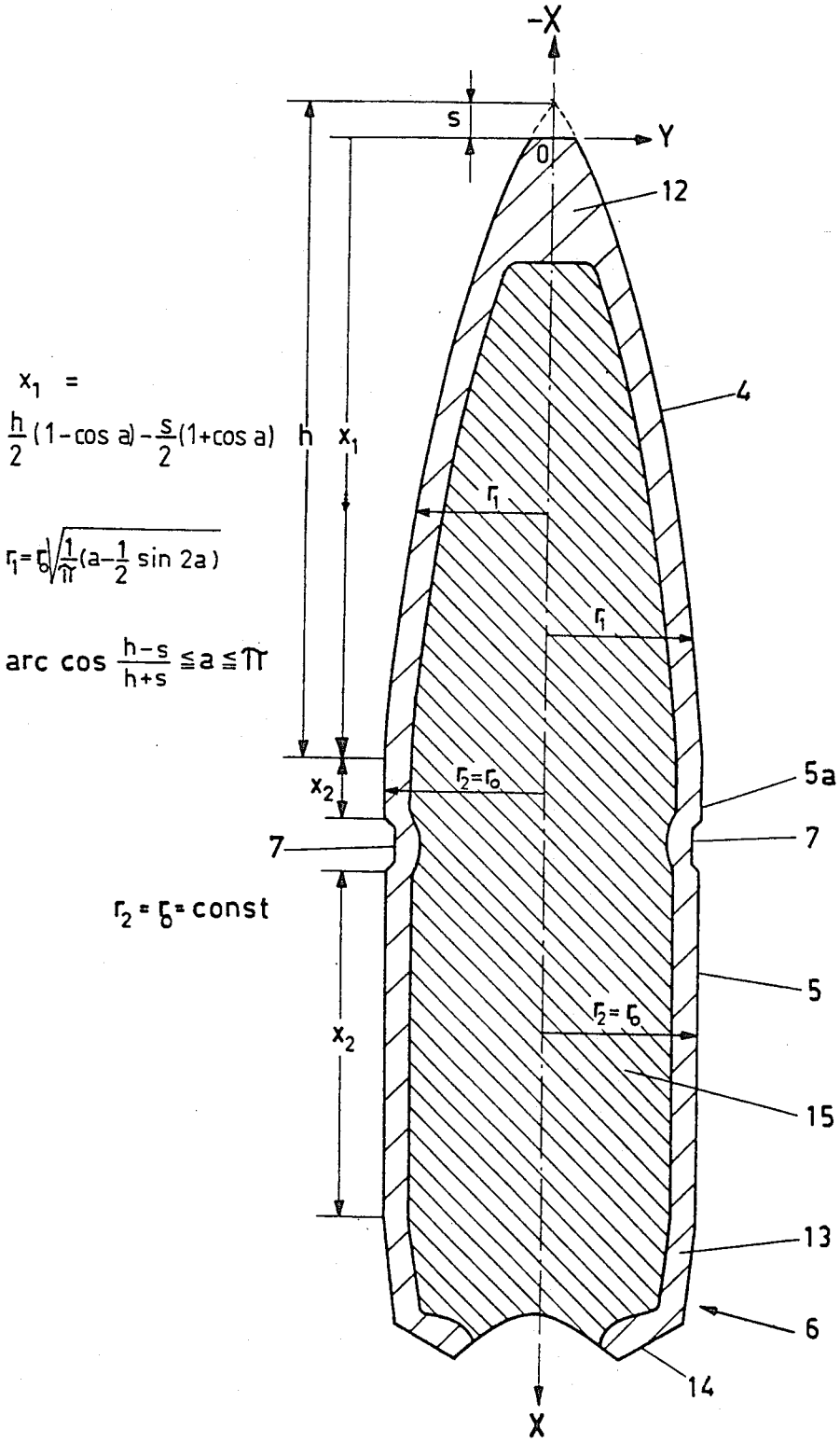
FIG. 2 shows a longitudinal section at an enlarged scale of a first embodiment of a jacket bullet for small arms ammunition according to the invention.

The aforementioned jacket bullet is illustrated in greater detail and at an enlarged scale in FIG. 2 in longitudinal section; the jacket bullet thus shown is of a rotationally symmetric shape optimized aerodynamically in respect of drag. The jacket bullet comprises a front portion 20 having a blunted front end 21 of solid material, a cylindrical central portion 22 including a groove 23, a rear portion 24 including two frustroconical sections 25 and 26 and a bullet core 27.

The jacket bullet has a profile determined by the parameter equation given further below which is derived in standard steps from the initially mentioned Haack equation relating to the minimum drag shape of large-calibre projectiles (expressed in terms of the drag coefficient $c_D$). In FIG. 2 the real front end of the jacket bullet is shown to be located in the origin of a rectangular coordinate system so that the height of the bullet extends along the positive x-axis in the coordinate system, while the radius thereof extends in the y-direction. Excepting the front end 21, the groove 23 and the rear portion 24, the profile of the jacket bullet is represented by a continuous function r(x) having a finite value of the associated continuous differential quotient (dr/dx). This function represents a sum function $$r(x) = r_1(x_1) + r_2(x_2)$$

encompassing a range $r_1(x_1)$ associated with a continuously decreasing differential quotient and a range $r_2(x_2)$ in which the differential quotient is constant and equal to zero and extending towards an imaginary tip displaced by $-s$ from the origin of the coordinate system.

In starting from the Haack equation (l.c.) for x the parameter equation $$x_1 = (h/2)(1-\cos a) - (s/2)(1+\cos a)$$

is obtained for the first member of the sum function as above. Therein h is the imaginary bullet height extending from $a = \pi$ to the imaginary tip, s is the displacement of the real front end 21 from the imaginary tip and "a" is a parameter which may assume any value in the range from arc cos $(h-s)/(h+s)$ to $\pi$. From the further Haack equation (l.c.) the following parameter equation for r $$r_1 = r_o\sqrt{\frac{1}{\pi}\left(a - \frac{1}{2}\sin 2a\right)},$$

is readily obtained for the first member of the sum function as above. Therein $r_0$ is the radius of the cylindrical portion 22 of the jacket bullet, $r_1$ is the radius of the jacket bullet in the range of $x_1$ and arc cos $(h-s)/(h+s) \leqq a \leqq \pi$. The second member in the sum function as above relates to the range $x_2 > h$ and is defined by $$r_2(x_2) = \text{constant} = r_0.$$

As will be readily evident, the profile determined by the aforementioned sum function is distinguished by an absolutely continuous transition between the ranges of $x_1$ and $x_2$ since in the case of $a=\pi$ the values of $r_1$ and $r_2$ become identical.

In the embodiment as shown, the value of s is 0.025 in (0.65 mm) or, respectively, 0.232 units of the bullet radius $r_0$ but may have any value in the range of 0.1 to 0.5 $r_0$. The front end 21 provides for a well-defined turbulence at the tip of the projectile during flight so that instabilities due to a substantially laminar flow are avoided. The cylindrical central portion 22 corresponding to the range of $x_2$ in the formula as given above has a groove 23 for attachment of a cartridge case as shown in FIG. 1. The groove 23 may be replaced by a knurled section as described above with reference to FIG. 1. In the embodiment as shown the cylindrical portion extends beyond the groove 23 by a section 22*a* having an axial length of 0.01 in (0.254 mm) or respectively, of about 0.1 unit of the bullet radius $r_0$ but may assume any value in the range of 0.1 to 0.5 $r_0$. At the end remote from the front portion 20 the central portion 22 is followed by the rear portion 24 comprising two substantially frustroconical sections 25 and 26. The interior section 25 has a cone angle of 8 degrees in this embodiment which may have any value in the range of 5 to 10 degrees; it has a length of 0.07 in (1.82 mm) corresponding to 0.65 units of the bullet radius $r_0$. The exterior section 26 has a cone angle of 60 degrees but may have any other value approximate thereto; it terminates at a distance from the symmetry axis. The aforementioned cone angles each have an imaginary apex located on an imaginary extension of the symmetry axis outside the bullet. The particular shape of the rear portion 24 assists in the effect of the specific profile on the flight properties of the projectile by favourably affecting the stability and the drag response.

The jacket bullet as described hereinbefore encloses a core made of lead or a lead alloy or any other conventional material like steel or sintered material.

Figure 3:
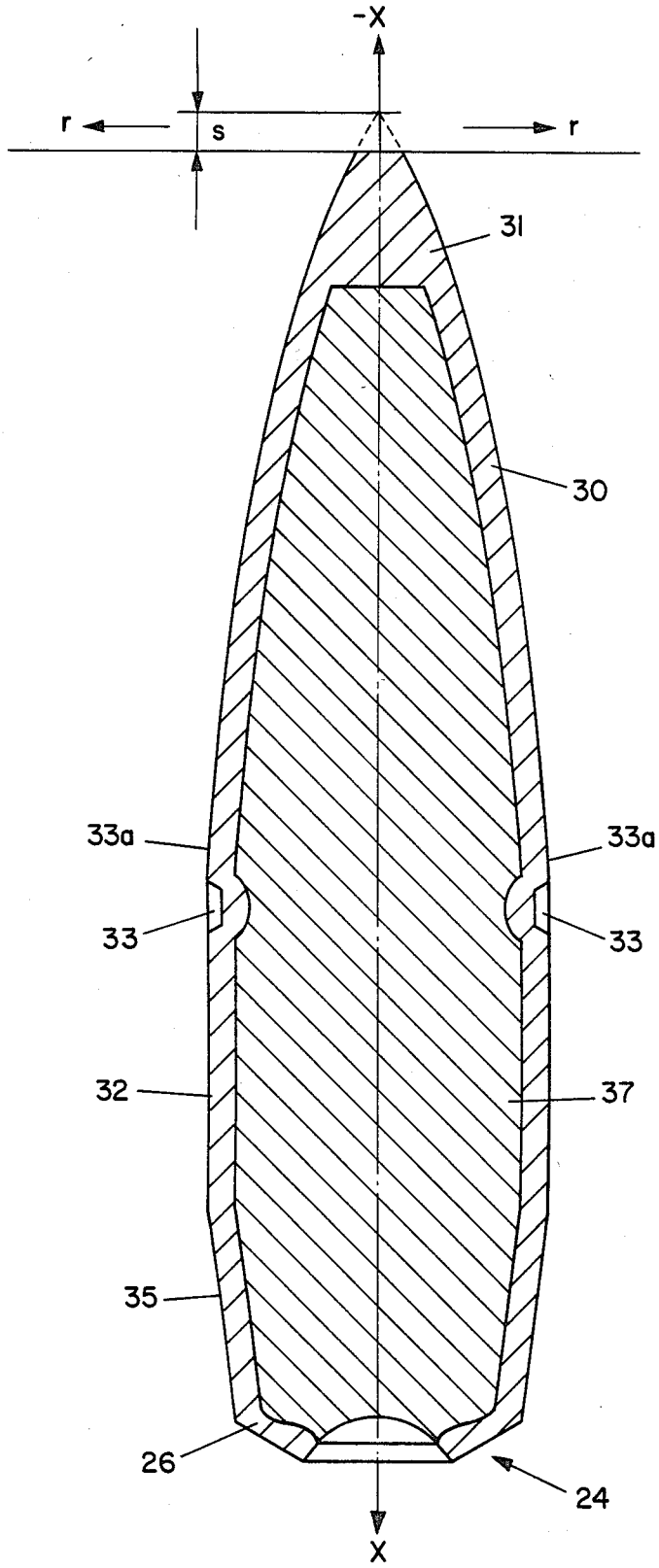
FIG. 3 shows a longitudinal section at an enlarged scale of a second embodiment of a jacket bullet for small arms ammunition according to the invention.

FIG. 3 shows a particularly preferred embodiment of the jacket bullet according to the invention in a drawing of the same kind as FIG. 2. There are recognized therein a profiled front portion 30 including a front end 31, a cylindrical central portion 32 including a groove 33 for attachment of a cartridge case, a rear portion 34 comprising two substantially frustroconical sections 35 and 36 and a core 37. While the jacket bullet shown in FIG. 3 is practically identical with the one shown in FIG. 2 with respect to material composition and in most dimensional aspects, the significant difference is in the interior frustroconical section 35 which has a cone angle of only 7 degrees and a length of 0.13 in (3.6 mm) or, respectively, of 1.3 units of the bullet radius $r_0$.

The small arms ammunition and the jacket bullet according to the invention as described hereinbefore are distinguished by having, contrary to expectation, very significant improvements in some important properties over those of the prior art ammunition and bullets of such kind in which the front portion is formed with an ogive, i.e. parabolically, conically or spherically. Of these properties the hit probability is the most important. In test firings this has been found to be considerably improved on; thus in the dispersion pattern the spread in the horizontal and in the vertical axis of the dispersion pattern proved to be better by 30 and 60 percent, respectively, at a firing range of 30 to 300 meters.

The following table gives data for some other important properties of a prior art conventional ammunition having a caliber of 0.223 Rem (5.56 mm) and the corresponding values obtained for ammunition according to the invention of the same caliber; also listed are the relative changes in the data in percent of the respective values as obtained with the prior art ammunition.

TABLE

Comparison of Absolute and Relative Test Data for the Prior Art Jacket Bullet and for the Jacket Bullet According to the Invention at Different Firing Ranges

| | | Jacket Bullet | | |
|---|---|---|---|---|
| | | | Acc. to Invention | |
| Test | Firing Range | Prior Art Absolute | Absolute | Relative (percent) |
| Vertex Height | 300 m | 0.19 m | 0.19 m | 0 |
| | 500 m | 0.73 m | 0.66 m | −10 |
| Flight Time | 300 m | 0.39 sec. | 0.39 sec. | 0 |
| | 500 m | 0.76 sec. | 0.74 sec. | −3 |
| Ballistic | 300 m | 706 J | 879 J | +25 |
| Final Impact Energy | 500 m | 357 J | 525 J | +47 |
| Crosswind | 300 m | 0.78 m | 0.59 m | −24 |
| Deflection | 500 m | 2.39 m | 1.87 m | −22 |

As will be a apparent from the table the jacket bullet which is aerodynamically optimized in shape with respect to drag according to the invention has a relatively less steep trajectory of flight and a somewhat smaller time of flight and, particularly at high firing ranges, a significantly higher ballistic final energy of impact. The crosswind deflection is reduced by the high amount of 25 percent at all firing ranges investigated although the projectile according to the invention has a higher weight and a lower muzzle velocity as compared to the corresponding data of the prior art projectile.

The data given in the table were determined in the usual manner by utilizing a known light barrier method to obtain the drag coefficient and by known calculations from the drag coefficient thus obtained.

The small arms ammunition including the jacket bullet as described hereinbefore has the particular advantage of being compatible with most of the important rifle designs presently in use. Contrary to the expectation explicitly expressed in the first mentioned prior publication the new jacket bullet profile does not require any changes in rifle design for its use.

I claim:

1. Small arms ammunition comprising:

a cartridge case containing a powder charge and having an open end, a closed end and a longitudinal axis;

a percussion cap substantially centered at said closed end with respect to the longitudinal axis of said cartridge case;

a rotationally symmetric jacket bullet enclosing a metallic core located at said open end;

said jacket bullet having opposed tip and rear ends, intermediate thereof an attachment section for attachment with said cartridge case and a radius r;

said jacket bullet having a shape which is aerodynamically optimized in respect of drag and other than at said rear end and said attachment section having a profile which extends from said tip end of said jacket bullet at the origin of a rectangular coordinate system, in which the x-axis represents a jacket bullet axis of symmetry and the y-axis represents a direction of said radius r of the jacket bullet, and which is substantially determined by a continuous function r(x), according to which the value of the radius r continuously increases from a predetermined value at said tip end of the jacket to a maximum value $r_0$ of the radius r and which has a continuous differential quotient (dr/dx) which has a finite positive value at said predetermined value of the radius r at said tip end of the jacket bullet and which decreases to a value of zero at the maximum value $r_0$ of the radius r;

the profile of the jacket bullet being determined, with the exception of the rear end and the attachment section for the cartridge case, by a sum function $$r(x)=r_1(x_1)+r_2(x_2)$$

in which the range of $x_1$ is defined in the range from x=0 to x=h by $$x_1=(h/2)(1-\cos a)-(s/2)(1+\cos a),$$

h representing an imaginary length of said bullet from $x_1$ as determined by $a=\pi$ to an imaginary tip of said bullet and arc cos $((h-s)/(h+s))\leqq a\leqq\pi$, while the associated values of $r_1$ are given by $$r_1 = r_0\sqrt{\frac{1}{\pi}\left(a-\frac{1}{2}\sin 2a\right)},$$

wherein arc cos $((h-s)/(h+s))\leqq a\leqq\pi$ and in which the range of $x_2$ is defined by $$x>h,$$

in which range $r_2$=constant=$r_0$;

wherein, in said sum function $r_1(x_1)=0$ when $x>h$ and $r_2(x_2)=0$ when $0\leqq x\leqq h$; and said profile of said jacket bullet having an imaginary tip which is spaced by a distance −s in the range of 0.1 to 0.5 $r_0$ from the origin of the rectangular coordinate system, at which said tip end of said bullet is located.

2. Small arms ammunition as defined in claim 1, wherein: the amount of the distance −s is in the range of 0.2 to 0.3 $r_0$.

3. Small arms ammunition as defined in claim 1, wherein: the attachment section for the cartridge case is displaced from an upper limiting value for $x_1$ into the range of $x_2$ by a distance in the range of 0.1 to 0.5 $r_0$.

4. Small arms ammunition comprising:

a cartridge case containing a powder charge and having an open end, a closed end and a longitudinal axis;

a percussion cap substantially centered at said closed end with respect to the longitudinal axis of said cartridge case;

a rotationally symmetric jacket bullet enclosing a metallic core located at said open end;

said jacket bullet having opposed tip and rear ends, intermediate thereof an attachment section for attachment with the cartridge case, and a radius r;

said jacket bullet having a shape which is aerodynamically optimized in respect of drag and other than at said rear end and said attachment section having a profile which extends from said tip end of said jacket bullet at the origin of a rectangular coordinate system, in which the x-axis represents a jacket bullet axis of symmetry and the y-axis represents a direction of said radius of the jacket bullet, and which is substantially determined by a continuous fraction r(x), according to which the value of the radius r continuously increases from a predetermined value at said tip end of the jacket to a maximum value $r_0$ of the radius r and which has a continuous differential quotient (dr/dx) which has a finite positive value at said predetermined value of the radius r at said tip end of the jacket bullet and which decreases to a value $r_0$ of zero at the maximum value of the radius r;

said function being a sum function $$r(x)=r_1(x_1)+r_2(x_2)$$

in which the range of $x_1$ is defined by the range from x=0 to x=h by $$x_1=(h/2)(1-\cos a)-(s/2)(1+\cos a),$$

h representing an imaginary length of said bullet from $x_1$ as determined by $a=\pi$ to an imaginary tip of said bullet and arc cos $((h-s)/(h+s))\leqq a\leqq\pi$, while the associated values of $r_1$ are given by $$r_1 = r_0\sqrt{\frac{1}{\pi}\left(a-\frac{1}{2}\sin 2a\right)},$$

wherein arc cos $((h-s)/(h+s))\leqq a\leqq\pi$, and in which the range of $x_2$ is defined by $$x>h$$

in which $r_2$=constant=$r_0$;

wherein, in said sum function $r_1(x_1)=0$ when $x>h$, and $r_2(x_2)=0$ when $0\leqq x\leqq h$;

said profile of the jacket bullet having an imaginary tip which is spaced by a distance −s in the range of 0.1 to 0.5 $r_0$ from the origin of the rectangular coordinate system at which said tip end of said bullet is located;

said rear end defining a rear portion comprising two substantially frustroconically-shaped sections defining an interior section and an exterior section; and said interior section having a cone angle in the range of 5 to 10 degrees and a length in the range of 0.5 to 2 $r_0$ and said exterior section having a cone angle of approximately 60 degrees and terminating at a distance from said bullet symmetry axis, the imaginary apices of said cone angles being located on said symmetry axis.

5. Small arms ammunition as defined in claim 4, wherein: the amount of the distance −s is in the range of 0.2 to 0.3 $r_0$.

6. Small arms ammunition as defined in claim 5, wherein: the attachment section for the cartridge case is displaced from an upper limiting value for $x_1$ into the range of $x_2$ by a distance in the range of 0.1 to 0.5 $r_0$.

7. Small arms ammunition as defined in claim 4, wherein: the jacket bullet is made of plated alloyed steel by deep drawing.

8. Jacket bullet as defined in claim 7, wherein: the amount of the distance −s is in the range of 0.2 to 0.3 $r_0$.

9. Rotationally symmetric jacket bullet for small arms ammunition comprising:

a jacket having opposed tip and rear ends, intermediate thereof an attachment section for attachment with a cartridge case and a radius r;

a metallic core contained within said jacket;

said jacket having a shape which is aerodynamically optimized in respect of drag and other than at said rear end and said attachment section having a profile which extends from said tip end of said jacket at the origin of a rectangular coordinate system, in which the x-axis represents a jacket axis of symmetry and the y-axis represents a direction of said radius of the jacket, and which is substantially determined by a continuous function r(x), according to which the value of the radius r continuously increases from a predetermined value at said tip end of the jacket to a maximum value $r_0$ of the radius r and which has a continuous differential quotient (dr/dx) which has a finite positive value at said predetermined value of the radius r at said tip end of the jacket and which decreases to a value of zero at the maximum value $r_0$ of the radius r the profile of said jacket being determined, with the exception of the rear end and the attachment section for the cartridge case, by a sum function $$r(x)=r_1(x_1)+r_2(x_2)$$

in which the range of $x_1$ is defined by the range from x=0 to x=h by $$x_1=(h/2)(1-\cos a)-(s/2)(1+\cos a),$$

h representing an imaginary length of said jacket from $x_1$ as determined by $a=\pi$ to the imaginary tip of said jacket and arc cos $((h-s)/(h+s))\leqq a\leqq\pi$, while the associated values of $r_1$ are given by $$r_1 = r_o\sqrt{\frac{1}{\pi}\left(a - \frac{1}{2}\sin 2a\right)},$$

wherein arc cos $((h-s)/(h+s))\leqq a\leqq\pi$, and in which the range of $x_2$ is defined by $$x>h,$$

in which $r_2$=constant=$r_0$;

wherein, in said sum function $r_1(x_1)=0$ when $x>h$, and $r_2(x_2)=0$ when $0\leqq x\leqq h$; and said profile of said jacket having an imaginary tip which is spaced by a distance −s in the range of 0.1 to 0.5 $r_0$ from the origin of the rectangular coordinate system at which said tip end of said jacket is located.

10. Jacket bullet as defined in claim 9, wherein: the attachment section for the cartridge case is displaced from an upper limiting value for $x_1$ into the range of $x_2$ by a distance in the range of 0.1 to 0.5 $r_0$.

11. Rotationally symmetric jacket bullet for small arms ammunition comprising:

a jacket having opposed tip and rear ends, intermediate thereof an attachment section for attachment with a cartridge case and a radius r;

a metallic core contained within said jacket;

said jacket having a shape which is aerodynamically optimized in respect of drag and other than at said rear end and said attachment section having a profile which extends from said tip end of said jacket at the origin of a rectangular coordinate system, in which the x-axis represents a jacket axis of symmetry and the y-axis represents a direction of said radius r of the jacket, and which is substantially determined by a continuous function r(x), according to which the value of the radius r continuously increases from a predetermined value at said tip end of the jacket to a maximum value $r_0$ of the radius r and which has a continuous differential quotient (dr/dx) which has a finite positive value at said predetermined value of the radius r at said tip end of the jacket bullet and which decreases to a value of zero at the maximum value $r_0$ of the radius r;

said function being a sum function $$r(x)=r_1(x_1)+r_2(x_2)$$

in which the range of $x_1$ is defined by the range from x=0 to x=h $$x_1=(h/2)(1-\cos a)-(s/2)(1+\cos a),$$

h representing an imaginary length of said bullet from $x_1$ as determined by $a=\pi$ to an imaginary tip of said bullet and arc cos $((h-s)/(h+s))\leqq a\leqq\pi$, while the associated values of $r_1$ are given by $$r_1 = r_o\sqrt{\frac{1}{\pi}\left(a - \frac{1}{2}\sin 2a\right)},$$

wherein arc cos $((h-s)/(h+s))\leqq a\leqq\pi$, and in which the range of $x_2$ is defined by $$x>h,$$

in which $r_2$=constant=$r_0$;

wherein, in said sum function $r_1(x_1)=0$ when $x>h$, and $r_2(x_2)=0$ when $0\leqq x\leqq h$;

said profile of the jacket having an imaginary tip which is spaced by a distance −s in the range of 0.1 to 0.5 $r_0$ from the origin of the rectangular coordinate system, at which said tip end of said jacket is located;

said rear end defining a rear portion comprising two substantially frustroconically-shaped sections defining an interior section and an exterior section; and said interior section having a cone angle in the range of 5 to 10 degrees and a length in the range of 0.5 to 2 $r_0$ and said exterior section having a cone angle of approximately 60 degrees and terminating at a distance from said jacket symmetry axis, the imaginary apices of said cone angles being located on said symmetry axis.

12. Jacket bullet as defined in claim 11, wherein: the amount of the distance −s is in the range of 0.2 to 0.3 $r_0$.

13. Jacket bullet as defined in claim 12, wherein: the attachment section for the cartridge case is displaced from an upper limiting value for $x_1$ into the range of $x_2$ by a distance in the range of 0.1 to 0.5 $r_0$.

14. Jacket bullet as defined in claim 13, wherein: the jacket bullet is made of plated alloyed steel by deep drawing.

* * * * *

UNITED STATES PATENT AND TRADEMARK OFFICE

CERTIFICATE OF CORRECTION

PATENT NO. : 4,517,897

DATED : May 21, 1985

INVENTOR(S) : Beat Kneubühl

It is certified that error appears in the above—identified patent and that said Letters Patent is hereby corrected as shown below:

Column 4, line 49, please delete "for r"

Column 7, line 68, please delete "fraction" and insert --function--

Signed and Sealed this

*Eighth* Day of *October 1985*

[SEAL]

*Attest:*

DONALD J. QUIGG

*Attesting Officer*

*Commissioner of Patents and Trademarks—Designate*